United States Patent [19]

Maghon

[11] 4,035,102

[45] July 12, 1977

[54] GAS TURBINE OF DISC-TYPE CONSTRUCTION

[75] Inventor: Helmut Maghon, Mulheim (Ruhr), Germany

[73] Assignee: Kraftwerk Union Aktiengesellschaft, Mulheim (Ruhr), Germany

[21] Appl. No.: 670,862

[22] Filed: Mar. 26, 1976

[30] Foreign Application Priority Data

Apr. 1, 1975 Germany ..... 2514208

[51] Int. Cl.[2] ..... F01D 5/18

[52] U.S. Cl. ..... 416/95; 416/97 R

[58] Field of Search ..... 416/95–97

[56] References Cited

U.S. PATENT DOCUMENTS

| | | | |
|---|---|---|---|
| 2,656,147 | 10/1953 | Brownhill et al. | 416/97 |

FOREIGN PATENT DOCUMENTS

| | | | |
|---|---|---|---|
| 978,608 | 4/1961 | France | 416/95 |
| 1,185,415 | 1/1965 | Germany | 416/95 |
| 17,121 | 4/1968 | Japan | 416/95 |
| 651,830 | 4/1951 | United Kingdom | 416/96 |
| 851,306 | 10/1960 | United Kingdom | 416/95 |
| 1,184,687 | 3/1970 | United Kingdom | 416/95 |

*Primary Examiner*—Everrette A. Powell, Jr.
*Attorney, Agent, or Firm*—Herbert L. Lerner

[57] ABSTRACT

In a gas turbine of disc-type construction having turbine discs mounted on a rotor shaft, with rings of U-shaped cross section interposed therebetween, the turbine discs having respective rotor blades secured in blade feet thereon, and a cooling system for the rotor blade feet including axial grooves formed in the feet as well as free annular gaps located between respective end faces of the turbine discs and the intermediate rings over the radial elevation of the feet, one of the annular gaps serving as a coolant gas feed chamber and being closed radially outwardly by a sealing ring and being connected radially inwardly to radial coolant gas feed channels, the other of the annular gaps being radially outwardly open and being sealed radially inwardly against the respective turbine disc, the improvement wherein the intermediate rings are formed with bores extending axially therein from the one annular gap serving as a coolant gas feed chamber from a location close to and radially inwardly of the sealing rings, the bores being traversible by coolant gas supplied from the one annular gap.

3 Claims, 3 Drawing Figures

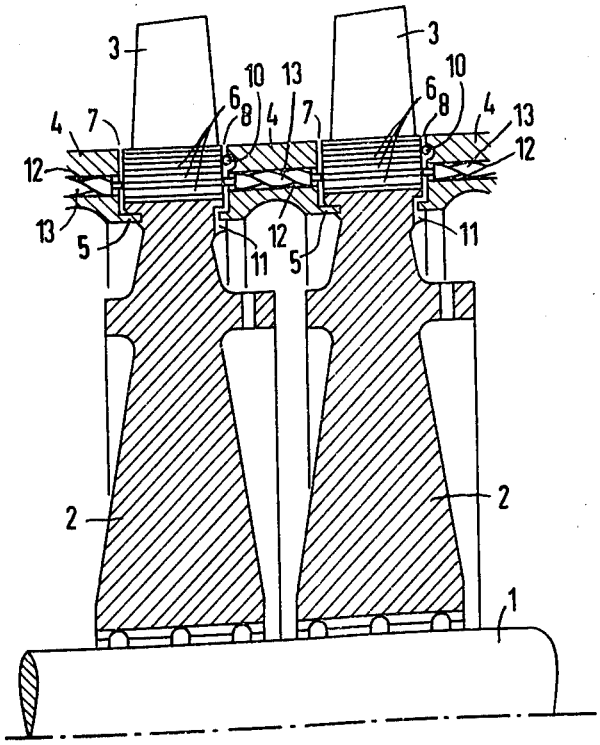

GAS TURBINE OF DISC-TYPE CONSTRUCTION

The invention relates to a gas turbine of disc-type construction and, more particularly, to such a gas turbine having rings of U-shaped cross section interposed between the turbine discs, and having a cooling system for the rotor blade feet thereof including axial as well as free annular gaps located between respective end faces of the turbine discs and the intermediate rings over the radial elevation of the blade feet, one of the annular gaps serving as a coolant gas feed chamber and being closed radially outwardly by a sealing ring and being connected radially inwardly to radial coolant gas feed channels, the other of the annular gaps being radially outwardly open and being sealed radially inwardly against the respective turbine disc.

A gas turbine of the foregoing type is disclosed in German Patent DT-PS 1 182 474. The cooling system for the rotor blade feet described therein also, in fact, effects a cooling, within given limits, of the intermediate rings but, however, only at the end faces thereof. With increasing turbine inlet temperatures, the intermediate rings must, however, also be cooled more intensely than has been the case for the heretofore known structures.

It is accordingly an object of the invention to provide a gas turbine of disc-type construction with a cooling system which will also adequately cool intermediate rings having a U-shaped cross section.

With the foregoing and other objects in view, there is provided in accordance with the invention, in a gas turbine of disc-type construction having turbine discs mounted on a rotor shaft, with rings of U-shaped cross section interposed therebetween, the turbine discs having respective rotor blades secured in blade feet thereon, and a cooling system for the rotor blade feet comprising axial grooves formed in the feet as well as free annular gaps located between respective end faces of the turbine discs and the intermediate rings over the radial elevation of the feet, one of the annular gaps serving as a coolant gas feed chamber and being closed radially outwardly by a sealing ring and being connected radially inwardly to a radial coolant gas feed channels, the other of the annular gaps being radially outwardly open and being sealed radially inwardly against the respective turbine disc, the improvement wherein the intermediate rings are formed with bores extending axially therein from the one annular gap serving as a coolant gas feed chamber from a location close to and radially inwardly of the sealing ring, the bores being traversible by coolant gas supplied from the one annular gap.

In accordance with another feature of the invention, filling members having a prismatic cross section are received in the bores, the filling members having a twist of at least 180° formed therein along substantially the total length thereof.

In accordance with a further feature of the invention, the cross section of the filling members is substantially square-shaped.

In this manner, the intermediate rings can also be adequately cooled, the bores being traversible over the entire length thereof with adequately cold coolant gas by the insertion of the twisted filling members into the bores.

Other features which are considered as characteristic for the invention are set forth in the appended claims.

Although the invention is illustrated and described herein as embodied in gas turbine of disc-type construction, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings in which.

Figure 1:
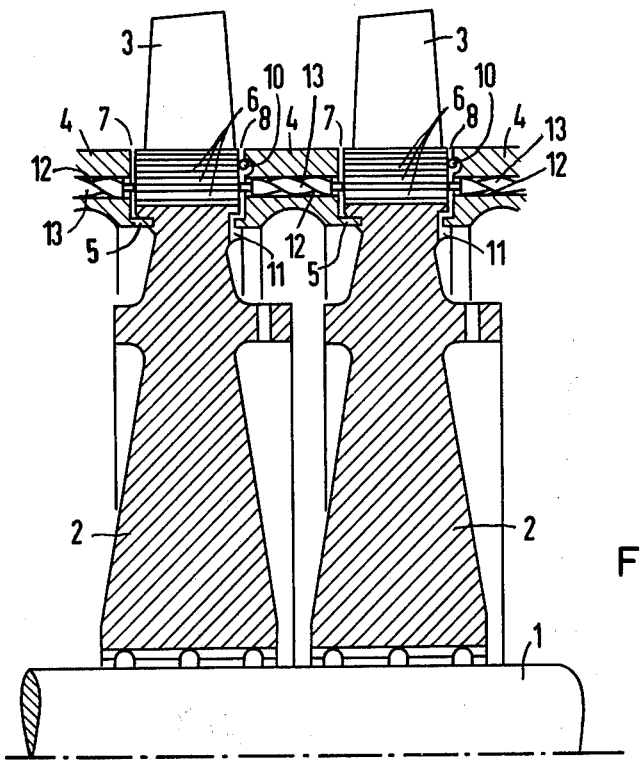
FIG. 1 is a longitudinal sectional view of part of a gas turbine of disc-type construction according to the invention showing two rotor discs with respective intermediate rings.

Referring now to the drawing and first, particularly, to FIG. 1 thereof, there is shown, in longitudinal sectional view, two turbine discs 2 mounted on a shaft 1 and carrying respective rotor blades 3. Intermediate rings 4 having a U-shaped cross section are furthermore provided between the individual turbine discs 2 and are formed with annular shoulders 5 by which they are clamped on one side thereof to the adjacent turbine disc 2. Annular gaps 7 and 8 are left free between the end faces of the intermediate rings 4 and the end faces of the paws or feet 6 of the rotor blades 3, the annular gaps 7 and 8, together with nonillustrated axial grooves formed in the blade 6 serving to conduct coolant gas. The coolant gas thus flows through radial feed channels 11 into the annular gap 8, which is formed as a coolant gas feed chamber, the annular gap 8 being sealed by a sealing ring 10 through radially outwardly acting centrifugal force during operation of the turbomachine. After the coolant gas has traversed or flowed through the grooves formed in the blade feet 6, it discharges through the annular gap 7 into the driving gas flow of the turbine.

Axial bores 12 formed in the intermediate rings 4 of U-shaped section in the vicinity of the surface thereof facing the driving gas flow of the turbine are provided for cooling the intermediate rings 4, the bores 12 extending from the annular gap 8, at a location below the sealing ring 10, and terminating in the annular gap 7 which is open radially outwardly i.e. not sealed as the annular gap 8 is sealed by the sealing ring 10. The coolant gas is thereby withdrawn from the same coolant feed chamber 8 from which the blade feet 6 also become cooled.

Figure 2:
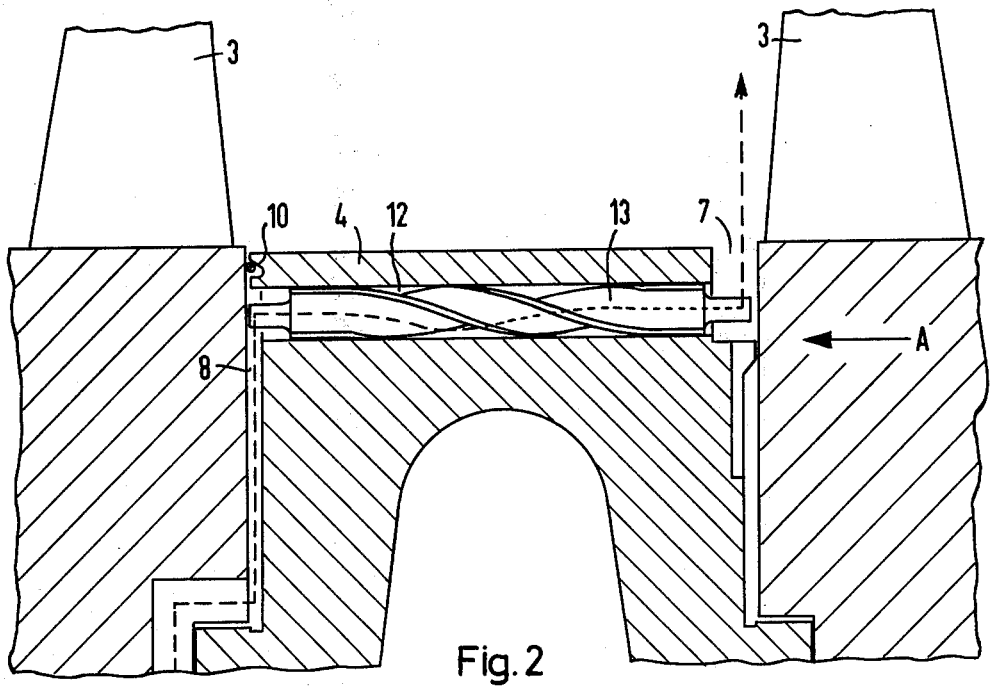
FIG. 2 is an enlarged fragmentary view of FIG. 1 showing part of one of the intermediate rings and the region surrounding it.
Figure 3:
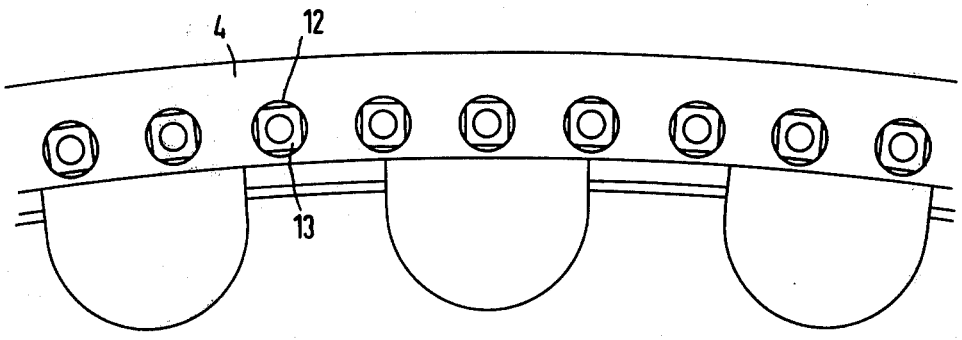
FIG. 3 is a fragmentary view, as seen in the direction of the arrow A in FIG. 2, of the intermediate ring formed with respective coolant-gas bores in which filling members are received.

In order to improve the best heat transfer, filling members 13 having a substantially prismatic cross section are inserted into the cooling-air bores 12. In the illustrated embodiment, especially as shown in FIG. 3, the filling members 13 expediently have a square cross section. The filling members 13 are twisted at at least through 180° over the total length thereof. Four substantially helically extending cooling channels are accordingly formed between the surface of the filling members 13 and the inner wall surface of the bores 12. Through this substantially helical course of the cooling channels, the coolant gas heated up in the first half of the coolant travel path is conducted away from the hot side of the bore 12 and the coolant gas heretofore flowing at the less hot side is employed in the second half of the coolant travel path for cooling the hot side of the bore 12 as is indicated by the coolant gas path represented by the broken-line arrow in FIG. 2.

Thus at relatively low cost, optimal cooling of the intermediate rings 4 is effected accordingly, without having to provide separate coolant gas feed channels therefor.

I claim:

1. In a gas turbine of disc-type construction having turbine discs mounted on a rotor shaft, with rings of U-shaped cross section interposed therebetween, the turbine discs having respective rotor blades secured in blade feet thereon, and a cooling system for the rotor blade feet comprising axial grooves formed in the feet as well as free annular gaps located between respective end faces of the turbine discs and the intermediate rings over the radial elevation of the feet, one of the annular gaps serving as a coolant gas feed chamber and being closed radially outwardly by a sealing ring and being connected radially inwardly to radial coolant gas feed channels, the other of the annular gaps being radially outwardly open and being sealed radially inwardly against the respective turbine disc, the improvement wherein the intermediate rings are formed with substantially cylindrical bores extending axially therein from the respective one annular gap serving as a coolant gas feed chamber from a location close to and radially inwardly of the sealing ring to the respective other annular gap that is open radially outwardly, the axial grooves formed in the respective rotor blade foot and said bores formed in the respective intermediate ring being traversible concurrently in substantially opposite axial direction by coolant gas supplied from said one annular gap.

2. Gas turbine according to claim 1 including filling members having a prismatic cross section received in said bores, said filling members having a twist of at least 180° formed therein along substantially the total length thereof.

3. Gas turbine according to claim 2 wherein the cross section of said filling members is substantially square-shaped.

* * * * *